US010023436B2

(12) United States Patent
Liebetrau

(10) Patent No.: US 10,023,436 B2
(45) Date of Patent: Jul. 17, 2018

(54) DRIVE WITH MULTIPLE LOOPING FOR AN ELEVATOR INSTALLATION

(71) Applicant: Inventio AG, Hergiswil (CH)

(72) Inventor: Christoph Liebetrau, Menziken (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/123,288

(22) PCT Filed: Feb. 10, 2015

(86) PCT No.: PCT/EP2015/052741
§ 371 (c)(1),
(2) Date: Sep. 2, 2016

(87) PCT Pub. No.: WO2015/132051
PCT Pub. Date: Sep. 11, 2015

(65) Prior Publication Data

US 2017/0217731 A1 Aug. 3, 2017

(30) Foreign Application Priority Data

Mar. 5, 2014 (EP) ..... 14157947

(51) Int. Cl.
*B66B 11/04* (2006.01)
*B66B 9/00* (2006.01)
*B66B 11/08* (2006.01)

(52) U.S. Cl.
CPC ..... *B66B 11/0438* (2013.01); *B66B 9/00* (2013.01); *B66B 11/08* (2013.01)

(58) Field of Classification Search
CPC ..... B66B 11/0438; B66B 11/08; B66B 9/00
See application file for complete search history.

(56) References Cited

U.S. PATENT DOCUMENTS 1,896,776 A * 2/1933 James ..... B66B 5/286 187/249
4,621,711 A * 11/1986 Miyashige ..... B66F 9/205 187/288

(Continued)

FOREIGN PATENT DOCUMENTS

CN 1488566 A 4/2004
CN 1571754 A 1/2005

(Continued)

*Primary Examiner* — Michael A Riegelman
(74) *Attorney, Agent, or Firm* — William J. Clemens; Shumaker, Loop & Kendrick, LLP

(57) ABSTRACT

A drive unit for an elevator installation having a first traveling body and a second traveling body, which traveling bodies are supported by a support device, drives the support device and thus the two traveling bodies. The two traveling bodies each have at least one first support roller by which the support device supports the traveling bodies, at least partially. The drive unit includes at least one first and one second roller arranged on a common axis of rotation of the drive unit, wherein at least one of the first or second rollers is a drive unit roller for driving the support device. On the way from the first traveling body to the second traveling body, the support device is guided over the first drive unit roller and over the second drive unit roller. The guidance is hereby such that the circumferential speeds of the two drive unit rollers vary.

14 Claims, 5 Drawing Sheets

(56) References Cited

U.S. PATENT DOCUMENTS

| | | | | | |
|---|---|---|---|---|---|
| 5,699,879 | A * | 12/1997 | Sakita | B66B 11/009 | 187/249 |
| 5,857,545 | A * | 1/1999 | Barrett | B66B 9/00 | 187/249 |
| 2006/0163006 | A1* | 7/2006 | Strebel | B66B 1/42 | 187/249 |
| 2006/0191747 | A1* | 8/2006 | Mustalahti | B66B 1/42 | 187/249 |
| 2009/0084634 | A1 | 4/2009 | Queen et al. | | |
| 2009/0301818 | A1* | 12/2009 | Hashiguchi | B66B 9/00 | 187/249 |
| 2012/0097484 | A1* | 4/2012 | Cortona | B66B 11/022 | 187/249 |

FOREIGN PATENT DOCUMENTS

| | | | |
|---|---|---|---|
| CN | 101007614 | A | 8/2007 |
| CN | 102105381 | A | 6/2011 |
| CN | 103298727 | A | 9/2013 |
| DE | 102004063130 | A1 | 7/2006 |
| DE | 102007018375 | A1 | 10/2008 |
| EP | 1400479 | A2 | 3/2004 |
| EP | 1553040 | A1 | 7/2005 |
| FR | 2922060 | A1 | 4/2009 |
| WO | 2006005215 | A2 | 1/2006 |
| WO | 2012115632 | A1 | 8/2012 |

* cited by examiner

DRIVE WITH MULTIPLE LOOPING FOR AN ELEVATOR INSTALLATION

FIELD

The invention relates to a drive unit for an elevator installation, to a corresponding elevator installation and to a method of supporting and driving travel bodies of an elevator installation.

BACKGROUND

Elevator installations are used for transporting passengers and loads between floors of a building. Different elevator systems are known for that purpose. Traction elevators usually comprise an elevator car and a counterweight, which are connected by way of support means, wherein the support means is guided by way of a drive unit. In that case the drive unit drives the support means by way of a drive pulley and thereby moves the car and the counterweight in the building upwardly and downwardly in mutually opposite travel directions. Two cars can also be used instead of a car and a counterweight. In general, these two travel bodies are moved relative to one another by the support means.

Various arrangements of support means in elevator installations are known. In part, the two travel bodies are arranged directly in a so-called 1:1 suspension. The two ends of the support means are each then fixedly connected with a respective travel body and the support means is guided by way of the drive pulley. The circumferential speed of the drive pulley, the speed of the support means and the speed of the travel bodies are identical. In the case of a so-called 2:1 suspension, the support means is fastened in the building and the travel bodies are suspended at the support means by way of support rollers. The circumferential speed of the drive pulley and the speed of the support means at the drive pulley are thus twice as high as the speed of the travel bodies. In the case of 4:1 suspension, the support means is fastened in the building and the travel bodies are suspended at the support means by way of support rollers with double hanging, wherein the support means is also appropriately guided in the building again by way of a roller. The circumferential speed of the drive pulley and the speed of the support means at the drive pulley are thus four times as high as the speed of the travel bodies. Thus, by way of the form of suspension, on the one hand the supporting force in the support means and a required drive moment at the drive pulley are reduced in correspondence with the selected suspension and the circumferential speed of the drive pulley is correspondingly increased.

An elevator installation with a 4:1 suspension is known from WO 2012/115632, wherein support means in the form of support belts are used and the associated rollers for deflection of the support belt are arranged in space-saving manner in the shaft. Equally, an elevator installation is known from WO 2006/005215, in which the required shaft rollers are arranged to be fanned out for preserving the support belt.

It is disadvantageous with the illustrated elevator installations that on the one hand the support belts are twisted between the rollers and in part exposed to additional diagonal tension due to rollers arranged to be laterally offset.

SUMMARY

It is accordingly an object to propose alternative concepts of subassemblies or arrangements of support means and associated deflecting rollers, which counteract at least in part the disadvantages known from the prior art or diminish these and/or which enable good space utilization.

An elevator installation comprises at least one first travel body and at least one second travel body. The two travel bodies are connected together by at least one support means or device. A drive unit is arranged between the two travel bodies in the path of the support means. The at least one support means is drivable by way of the drive unit, whereby the two travel bodies can be supported and moved. The two travel bodies each comprise at least one first support roller and the support means at least partly supports the travel bodies by way of these support rollers. In addition, the drive unit comprises at least one first drive unit roller and at least one second drive unit roller, which are arranged on a common rotational axis of the drive unit. At least one of these first and second drive unit rollers is a drive unit roller or drive pulley for driving the support means.

The at least one support means is preferably guided from the first to the second travel body by way of the first and second drive unit rollers and the guidance of the support means as well as the configuration of the drive unit is such that the circumferential speeds of the two drive unit rollers are different during movement. This is advantageous, since as a result—particularly in the case of suspensions above 2:1, thus, for example, in the case of 3:1, 4:1 suspensions and obviously also in the case of even greater degrees of translation in the suspension—a compact, space-saving arrangement can be achieved. In addition, support means guides can be realized without twisting of support means, which is advantageous particularly when support belts are used as support means.

The at least one drive unit roller or drive pulley for driving the support means is preferably drivable by way of a drive motor. The other one of the first and second drive unit rollers is either arranged to be freely rotatable on the common rotational axis of the drive unit or is similarly motor-drivable. Consequently, as a matter of choice merely the support force in the support means can be reduced insofar as the other one of the first and second drive unit rollers is arranged to be freely rotatable or the support force in the support means can be reduced and at the same time the drive power to be introduced into the support means by the drive can be distributed to several drive unit rollers insofar as the other one of the first and second drive unit rollers is similarly arranged on the common rotational axis of the drive unit to be motor-drivable.

In the case of an arrangement with a motor-drivable other drive unit roller or drive pulley this other drive unit roller or drive pulley can be driven by the same drive motor, which thus can drive the first and second drive unit rollers. In that case, for example, present between the first and second drive unit rollers is a geometric translation through use of different diameters, a transmission stage, a differential transmission and/or a resilient coupling.

In an alternative arrangement with a motor-drivable other drive unit roller or drive pulley this other drive unit roller or drive pulley can be driven by another or a separate drive motor. Introduction of drive force into the support means can thereby be controlled in accordance with need.

The elevator installation preferably comprises a second drive unit or deflecting device with a third drive unit roller and a fourth drive unit roller. These third and fourth drive unit rollers are, as in the case of the first drive unit, arranged on a common rotational axis of the second drive unit or the deflecting device. The support means is thus also guided by way of the third and fourth drive unit rollers on its path from the first to the second travel body. In addition, in that regard the circumferential speeds of the third and fourth drive unit rollers are different. This is advantageous, since as a result a drive moment can be distributed to two smaller units. This is particularly advantageous if for reasons of cable guidance an additional deflection is required in any case. Moreover, a space-saving arrangement also arises through the mentioned configuration of the second drive unit or the deflecting device.

Preferably, at least the first travel body comprises a second support roller and the support means is led in a 4:1 suspension to the first travel body or the support rollers thereof. In that regard, the support means is led, starting from a first stationary fastening point in a shaft of the elevator installation, to the first support roller of the first travel body. From there it is led onward to the first drive unit roller of the drive unit and is again led back to the second support roller of the first travel body. The support means is led on from the second support roller of the first travel body to the second drive unit roller of the drive unit. The circumferential speed of the second drive unit roller of the drive unit approximately corresponds with twice the circumferential speed of the first drive unit roller. The term "approximately" is also to be understood for the subsequent explanations in the sense that, especially when the first and second drive unit rollers are designed to be driving, differences between the two rollers caused by stretching or caused by slip can arise. Otherwise, in a stretch-free and slip-free consideration a difference, which corresponds with the translation of the suspension, of the circumferential speeds of the two drive unit rollers obviously arises.

This form of support means guidance is advantageous, since due to the large translation in the suspension a further reduction in the supporting force in the support means can be achieved and since the resulting high drive unit roller speed enables use of smaller motors.

In a developed embodiment, particularly in the case of use of the second drive unit or the deflecting device, the second travel body further comprises a second support roller and the support means is equally guided in a 4:1 suspension to the second travel body or the support roller thereof. The support means is accordingly led on from the second drive unit roller of the drive unit to the fourth drive unit roller of the second drive unit or the deflecting device. From this fourth drive unit roller the support means is led onward to the second support roller of the second travel body and after looping around the same is led back to the second drive unit or the deflecting device and there guided by way of the third drive unit roller thereof. The support means is led on from the third drive unit roller to the first support roller of the second travel body and finally, after looping around this first support roller of the second travel body, led onward to a second stationary fastening point of the support means in the shaft and fastened there.

This developed embodiment is advantageous, since the two travel bodies thereby operate with the same translations, as a result of which, in particular, the travels are the same.

As an alternative to the embodiment described in the foregoing the second travel body has a fastening point for fastening of the support means and the second travel body is arranged in a 3:1 suspension. In that case, the support rollers of the second travel body are preferably arranged below the travel body.

This alternative embodiment is advantageous, since, for example, the first travel body, in particular a counterweight, can thus be executed with a 4:1 suspension and the second travel body, particularly an elevator car, with a 3:1 suspension. The travel path of the first travel body is thus merely ¾ of the travel path of the second travel body. Thus, for example, sufficient space remains above the second travel body for arrangement of the drive unit. Moreover, diagonal tension of the support means, which is caused by double looping around the rotational axis of the drive unit, can be reduced to a small angular range. As a result, overall a compact elevator installation with a small need for space is provided.

The rotational axes of the support rollers of the first and second travel bodies, the rotational axis of the drive unit with the associated drive unit rollers and if applicable the rotational axis of the second drive unit or the deflecting device together with the associated drive unit rollers are preferably oriented to be parallel with one another. This arrangement allows use of support means in the form of support belts.

Consequently, space-saving arrangements can be realized.

The support rollers of the first travel body are preferably arranged in the upper region and/or above the first travel body and the support rollers of the second travel body are arranged in the lower region of the second travel body and/or below the second travel body.

These possible embodiments allow optimum placement of the drive unit and local space conditions can be satisfactorily taken into consideration. This is of advantage particularly in the context of modernizations, since with such projects the spaces are predetermined.

For preference, the first travel body is a counterweight and the second travel body is an elevator car. The support rollers of the elevator car are in that regard preferably arranged below the elevator car so that the support means are guided below the elevator car. This enables a space-saving embodiment of the elevator installation as already explained in connection with the different suspensions. The first and second travel bodies are obviously interchangeable. This means that the first travel body can also be constructed as an elevator car and the second travel body as a counterweight or obviously also both travel bodies can be constructed as elevator cars.

The support means is preferably a support belt, preferably a support belt with a poly-V-ribbed traction surface, and the drive unit rollers of the drive unit and the support rollers of the two travel bodies have a traction surface or guide surface shaped in correspondence with the shape of the support belt. Support means of that kind have good traction and make possible small deflection radii. These support belts thus enable a space-saving mode of construction.

At least two parallelly extending support means are preferably used for supporting and driving the first and second travel bodies and the drive unit preferably comprises two drive unit roller sets. Each of the two drive unit roller sets further comprises a respective first drive unit roller and second drive unit roller and the two drive unit roller sets are arranged on the common rotational axis of the drive unit. Thus, in particular, safety of the installation can be increased, since the travel bodies are supported by redundant support means and introduction of force into the travel bodies can take place, for example, substantially symmetrically with respect to a guide plane of the two travel bodies.

For preference, the support belt or belts in the path from the first fastening point to the second fastening point is or are guided to always be bent in the same sense around the support rollers and drive unit rollers. The service life of the support belts can thus be optimized.

The drive unit, as is preferably used for an afore-described elevator installation, comprises a drive motor, a first drive unit roller and a second drive unit roller. These are arranged on a common rotational axis. Arranged on a common rotational axis means that the drive unit rollers are arranged coaxially with one another so that they are disposed along a common axis. At least one of the first and second drive unit rollers is provided with a traction surface for driving a support means and this drive unit roller, which is provided for driving the support means, is coupled with the drive motor.

In one embodiment, the other one of the first or second drive unit rollers is also coupled with the one drive motor. The coupling is such that when the drive unit rollers are driven by means of the drive motor the circumferential speeds of the two drive unit rollers are different or at least can be different. The one drive motor is in that sense a single drive motor which thus simultaneously drives the first and second drive unit rollers.

This is advantageous, since by means of this solution a drive force can be satisfactorily introduced into the support means. The looping angle can be selected to be large.

Alternatively, the other one of the first and second drive unit rollers is arranged on the common rotational axis to be freely rotatable. In operation of the elevator installation, it is thus possible to set the circumferential speed of the freely rotatable drive unit roller in accordance with the speed of the support means guided by way of this freely rotatable drive unit roller. The other one of the first and second drive unit rollers is thus not motor-driven. This is advantageous, since the drive unit can be of simple design.

In one variant of embodiment the first drive unit roller preferably has a roller diameter different from the second drive unit roller, so that a circumferential speed, which is different in correspondence with the roller diameter, of the two drive unit rollers arises. The two drive unit rollers can thus be directly coupled with the drive motor by way of a drive axis arranged on the common rotational axis. The drive axis can be gearlessly driven by the drive motor or it can also be driven by the drive motor by way of a transmission.

In another preferred embodiment of the drive unit one of the first and second drive unit rollers is directly coupled with the drive axis and the other one of the first and second drive unit rollers is coupled with the drive axis by way of a speed-change transmission, so that a circumferential speed, which is different in correspondence with the translation of the speed-change transmission, of the two drive unit rollers arises. In the case of this embodiment as well the drive axis can be gearlessly driven by the drive motor or the drive axis can be driven by the drive motor by way of a transmission.

The circumferential speeds, which correspond with the selected suspension, of the respective drive unit rollers can be achieved by means of the different roller diameters or the speed-change transmission.

For preference the two driven drive unit rollers are coupled together by a viscous coupling or a differential transmission or by a slip clutch. Thus, small rotational speed differences, such as arise due to support-means slip or stretching in the support means, can be equalized. The slip clutch has a particularly good cost/utilization ratio, since the rotational speed differences result merely from deviations caused by stretching and slip. The entire drive force can be transmitted efficiently and uniformly to the support means by way of a differential transmission. The support means can thus be preserved and wear can be kept small.

The drive unit preferably respectively comprises two first drive unit rollers and two second drive unit rollers, wherein each drive unit roller set consists of a first and a second drive unit roller and the drive motor is arranged centrally between the two drive unit roller sets. The elevator installation can thus be operated by two separate support means. This increases the safety of the elevator installation, since in the case of failure of a support means the travel bodies of the elevator installation are still supported.

Embodiments with more than two drive unit roller sets are obviously also possible. Thus, elevator installations for greater loads can be realized.

In one variant of embodiment the drive motor is coupled with the drive axis by way of a transmission, preferably a worm transmission, and a motor axis of the drive motor is arranged substantially at right angles to the drive axis. In this embodiment the motor axis of the drive motor is arranged substantially parallel to the drive axis and the motor axis is coupled with the drive axis by a gearwheel transmission or belt transmission. Alternatively, the motor axis of the drive motor is constructed integrally with the drive axis and the drive motor drives the drive axis gearlessly. Thus, a drive concept corresponding with requirements (need for space, price, etc.) can be selected.

DESCRIPTION OF THE DRAWINGS

Preferred embodiments of the invention are explained in more detail in the following description on the basis of the accompanying drawings, in which corresponding elements are provided with corresponding reference numerals and in which.

DETAILED DESCRIPTION

Figure 1:
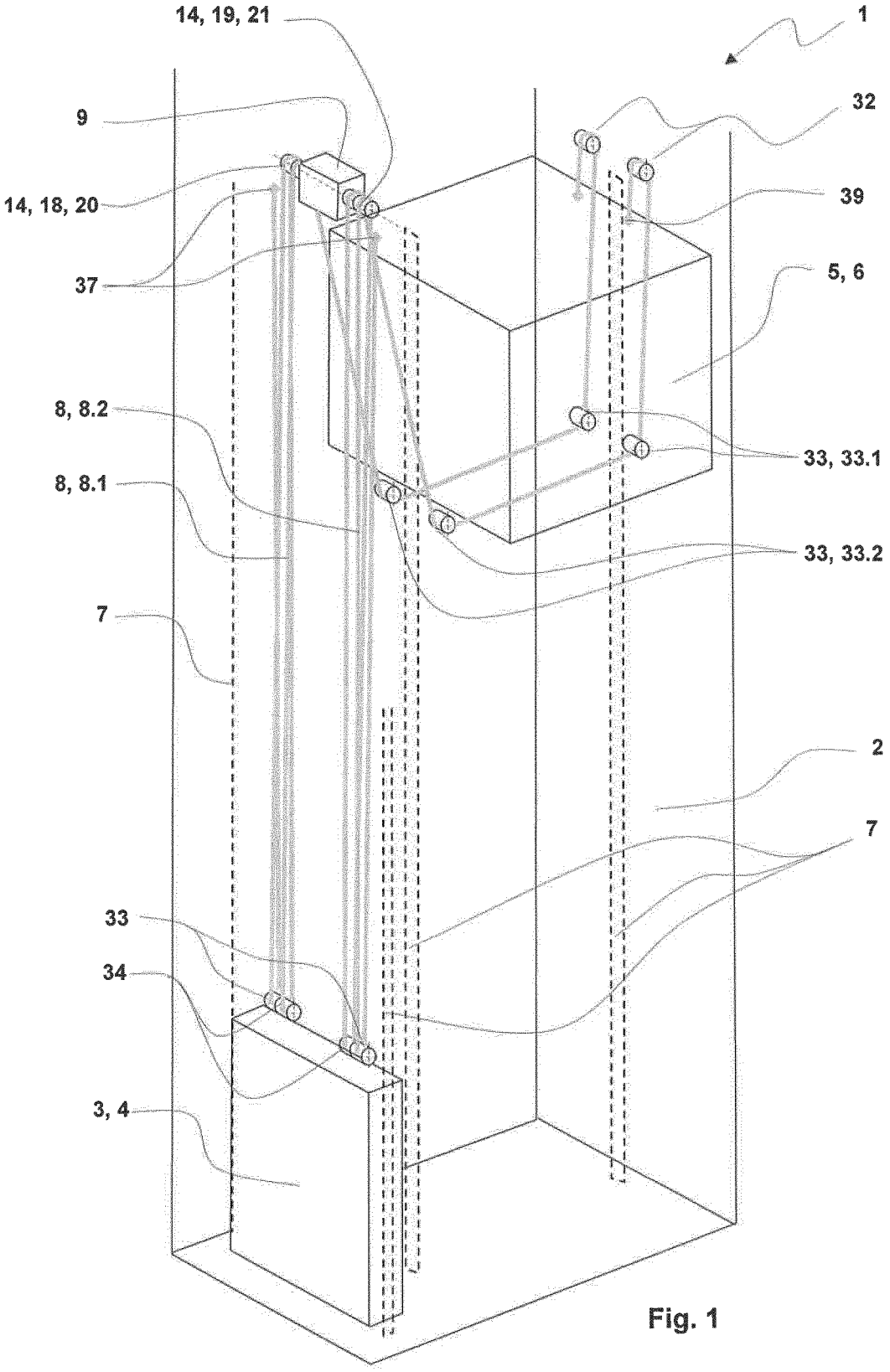
FIG. 1 shows a schematic overall view of an elevator installation.
Figure 2:
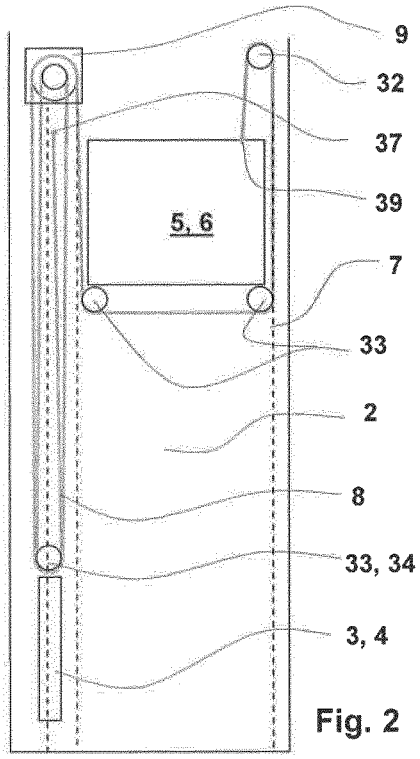
FIG. 2 shows a schematic side view of the elevator installation of FIG. 1 with the elevator car in an uppermost stopping region.
Figure 3:
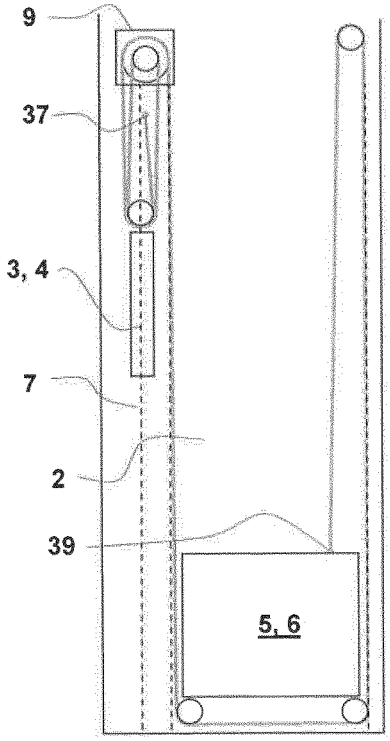
FIG. 3 shows a schematic side view of the elevator installation of FIGS. 1 and 2 with the elevator car in a lower stopping region.

FIG. 1 shows an elevator installation 1 with a drive unit 9 in a shaft 2. FIGS. 2 and 3 show the elevator of FIG. 1 in a schematic side view and in different positions in the shaft 2. In that regard, the elevator installation 1 comprises a first travel body 3, which is constructed as a counterweight 4, and a second travel body 5, which is constructed as an elevator car 6. The elevator car 6 and the counterweight 4 or the two travel bodies 3, 5 are arranged to be movable along guide rails 7. The elevator car 6 and counterweight 4 are supported by support means or devices 8 and connected together. The drive unit 9 supports and drives the support means 8 and can thereby move the two travel bodies 3, 5 in the shaft relative to one another. In the present example, two parallel runs of support means 8, 8.1, 8.2 are used, which extend substantially on the left and right of a plane determined by the guide rails 7 of the elevator car 6. Obviously, the number of required runs of support means results from the elevator data such as elevator masses and transport weights present, kind of support means or conveying height, etc. The form of arrangement of the several runs is determined by the expert.

In the example according to FIG. 1 the counterweight 4 or the first travel body 3 is connected with the drive unit 9 by a 4:1 suspension and the elevator car 6 or the second travel body 5 is connected with the drive unit 9 by a 3:1 suspension. By 4:1 suspension there is understood in this regard that a support means run 8.1 carries the respective travel body 3, 5 by way of four sub-lengths. A tension force in the support means 8 thus amounts to a quarter of the support force of the entire support means run 8.1. Analogously, in the case of a 3:1 suspension the tension force in the support means 8 amounts to a third of the support force of a support means run 8.2. The form of suspension translation can obviously be varied. Depending on the respective requirement it can be selected to be the same for the two travel bodies or it can be selected to be different, as in the present example. The special effect of the present division is discussed later.

The support means 8 is now fastened by one end to a first stationary fastening point 37 in the shaft 2 of the elevator installation 1. The support means forces can be introduced in known mode and manner into the guide rails 7 by way of fastening brackets or they can be introduced into the shaft wall or into a shaft ceiling or into a carrier or drive frame of the drive unit 9. From the first stationary fastening point 37 the support means 8 is led to the counterweight 4 or the first travel body 3 or to a first support roller 33 of the first travel body 3. From there it is led back to the drive unit 9, where it loops around a first drive unit roller 18, 19. In addition, the support means is led back again to a second support roller 34 of the first travel body 3 and from there led again to the drive unit 9, where it loops around a second drive unit roller 20, 21 of the drive unit 9. At least one of the drive unit rollers 18, 19, 20, 21 is constructed as a drive unit roller 14 and can drive the support means 8. The circumferential speed of the second drive unit roller 20, 21 of the drive unit 9 in that case approximately corresponds with twice the circumferential speed of the first drive unit roller 18, 19, and the circumferential speed of the first drive unit roller 18, 19 approximately corresponds with twice the linear speed of the first travel body 3. The first travel body 3 is thus connected with the drive unit 9 by means of a 4:1 suspension.

Embodiments of drives 9 such as can be used for the present invention are illustrated in the embodiments with respect to FIGS. 8 to 12.

The support means 8 is now led from the second drive unit roller 20, 21 of the drive unit 9 to a first support roller 33 of the second travel body 5 or the elevator car 6. In the present embodiment, the first support roller 33 is arranged below the elevator car 6 and is divided into two rollers 33.1 and 33.2, which are arranged in the lateral regions of the elevator car 6 on both sides. The support means 8 can thus be led below the elevator car 6 to an opposite side of the elevator car. From there the support means 8 is led to a deflecting roller 32 arranged in the shaft 2. In addition, the support means is led from the deflecting roller 32 to the elevator car 6, where it is fastened by means of a fastening point 39 to the second travel body 5 or to the elevator car 6. The second travel body 5 is thus connected or supported with respect to the drive unit 9 by means of a 3:1 suspension.

In FIG. 2, which illustrates an operational situation of the elevator installation of FIG. 1, the elevator car 5, 6 is disposed at the upper end of its travel range. The counterweight 3, 4 is accordingly disposed at the lower end of its travel range or approximately right at the bottom in the shaft 2. In FIG. 3 the elevator car 5, 6 is disposed at the lower end of its travel range, i.e. approximately right at the bottom in the shaft 2. The counterweight 3, 4 is accordingly disposed at the upper end of its travel range. In that regard, however, the counterweight does not have to cover a smaller path, since it is connected with the drive unit 9 by means of a 4:1 suspension, whereas the elevator car is suspended by means of a 3:1 suspension. Disposed above the counterweight 3, 4 is consequently a residual region corresponding with approximately a quarter of the travel path of the elevator car. This residual region can now ideally be used in order on the one hand to minimize diagonal tension in the support means or possibly to accommodate shaft installations such as a controller, a converter, a battery pack or something else.

Diagonal tension in the support means necessarily arises in the case of the illustrated embodiment, since the support means in the case of double guidance between counterweight 3, 4 and drive unit 9 has to be laterally displaced by at least the width of the support means. In the case of the illustrated embodiment, a large spacing between support rollers 33, 34 and drive unit rollers 18 to 21 is achievable in simple manner not only with the elevator car 5, 6, but also with the counterweight 3, 4.

Figure 4:
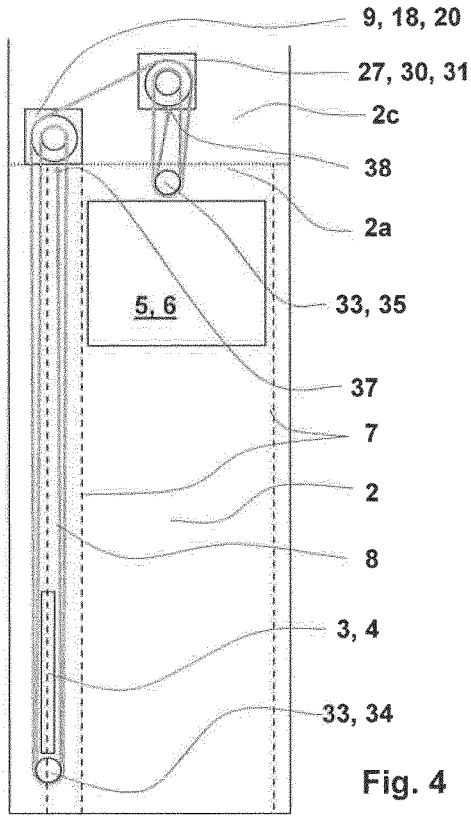
FIG. 4 shows a schematic side view of another elevator installation with two drive units.

In the embodiment according to FIG. 4, by contrast to the previous embodiments the support rollers 33, 34 of the first travel body 3 or of the counterweight 4 are arranged below the travel body. The support means 8 are accordingly guided near the counterweight 4. The counterweight can obviously also be provided with corresponding lateral channels or recesses. Moreover, a second drive unit 27 is arranged in the upper region of the shaft or in an engine room 2*c* lying in a prolongation of the shaft and further support rollers 33, 35 are arranged at the elevator car. The support means 8 is thus, starting from the second drive unit roller 20 of the drive unit 9, led to the third drive unit roller 30 of the second drive unit 27 (corresponding with the second drive unit roller 20 of the drive unit 9) and runs from there to the second support roller 35 of the second travel body 5 or the elevator car 6. From the elevator car 6 the support means 8 is led back to the drive unit 27, where it loops around a fourth drive unit roller 31 (corresponding with the first drive unit roller 18 of the drive unit 9). Moreover, it runs once more to the elevator car 6, loops around the first support roller 33 thereof and is finally led to a second, stationary fastening point 38 and thus fixed in the shaft 2 or, in the illustrated embodiment, to the drive unit 27. In the present embodiment, both travel bodies 3, 5 are thus suspended in a 4:1 suspension. In the example, an intermediate base or ceiling 2*a* separates the engine room 2*c* with the drive units 9, 27 from the underlying travel region of the shaft. The second drive unit 27 is raised so that a minimum distance between the drive unit rollers 30, 31 and the support rollers 33, 35 of the elevator car 6 can be achieved. The embodiment with engine room 2*c* is advantageous, for example, in the case of rebuilding when already existing engine rooms can be used.

The guide rails 7 are so arranged in FIGS. 1 to 4 that two guide rails 7 of the counterweight 4 and one guide rail 7 of the elevator car 6 extend on one side of the elevator car 6, whilst a further guide rail 7 of the elevator car 6 extends on another side of the elevator car 6.

Figure 5:
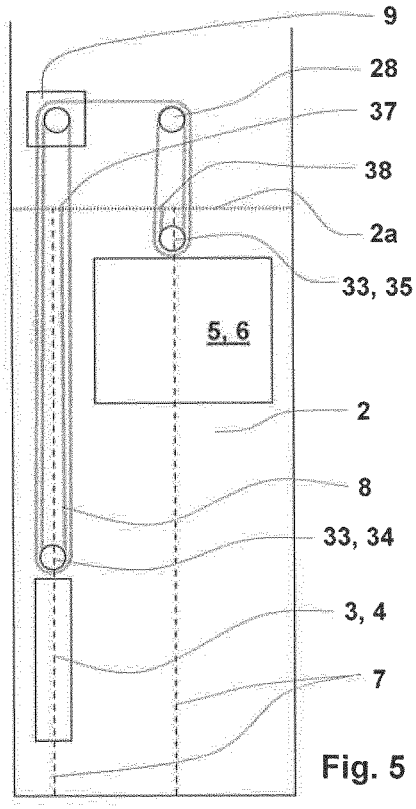
FIG. 5 shows a schematic side view of a further elevator installation with a drive unit and a deflecting device.

In the embodiment according to FIG. 5, by contrast to the preceding embodiment use is made of a deflecting device 28 instead of the second drive unit 27, the stationary fastening points 37, 38 are fastened to the intermediate ceiling 2*a*, the drive unit 9 is raised and the support rollers of the first travel body 3 are arranged above the travel body as in the embodiment of FIG. 1. In FIG. 5, the guide rails 7 of the counterweight 4 and the elevator car 6 are arranged in parallel planes with respect to one another.

Figure 6:
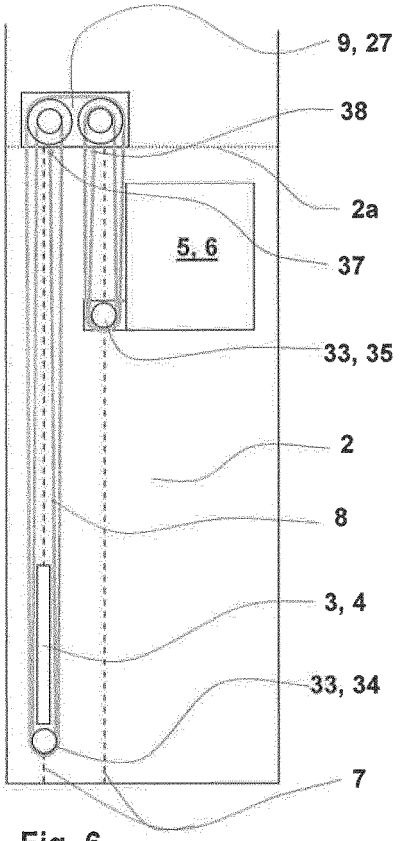
FIG. 6 shows a schematic side view of another example of an elevator installation with two drive units combined to form a unit.

In addition, in the embodiment according to FIG. 6 both travel bodies 3, 5 are suspended in a 4:1 suspension. However, by contrast to FIG. 4 the support rollers 33, 35 of the second travel body 5 or the elevator car 6 are arranged laterally of the elevator car 6 in the vicinity of the lower boundary of the elevator car. The two drive units 9, 27 are combined into one unit and all guide rails 7 are arranged on one side of the elevator car 6. The elevator car 6 is guided in a so-called rucksack arrangement. With this embodiment, a large distance between drive unit rollers and support rollers can always be ensured. Thus, a diagonal tension, which arises due to the double looping-around of the drive unit rollers, can be minimized. Moreover, a load of the drive units 9, 27 can be introduced into all guide rails 7. Obviously, in this embodiment one of the drive units 9, 27 can also be executed merely as a deflecting unit. The intermediate base 2*a* can, as shown, be arranged between drive unit 9, 27 and shaft 2. However, the intermediate base 2*a* can also be eliminated, whereby an elevator without an engine room arises.

Figure 7:
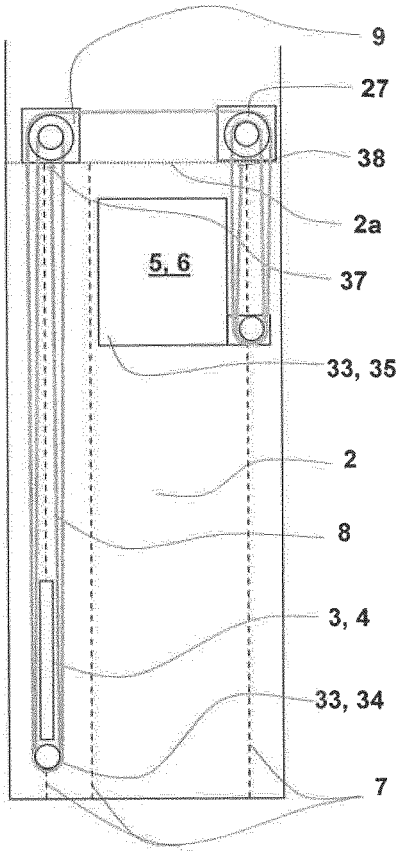
FIG. 7 shows a schematic side view of a fifth example of an elevator installation with two drive units.

In the embodiment according to FIG. 7, by contrast to FIG. 6 the second drive unit 27 is arranged as a separate unit on the side of the elevator car 6 opposite to the counterweight. The support means 8 crosses the shaft 2 above the elevator car 6. Similarly, the guide rails 7 are executed in the arrangement originally shown in FIGS. 1 to 4.

The illustrated arrangements can obviously be combined. In the case of all embodiments, intermediate ceilings 2*a* are possible for formation of an engine room, and the stationary fastening points 37, 38 can be connected with rails, walls, ceilings, the drive units 9, 27 or the deflecting device 28. In addition, the deflecting device 28 can be constructed as a drive unit or the drive units 9, 27 as deflecting devices. At least one drive unit obviously has to be present in the elevator installation. This could in principle obviously be apportioned to any of the support or deflecting rollers or to all of them. The form of guidance of the travel bodies is not explained in more detail here.

Figure 8:
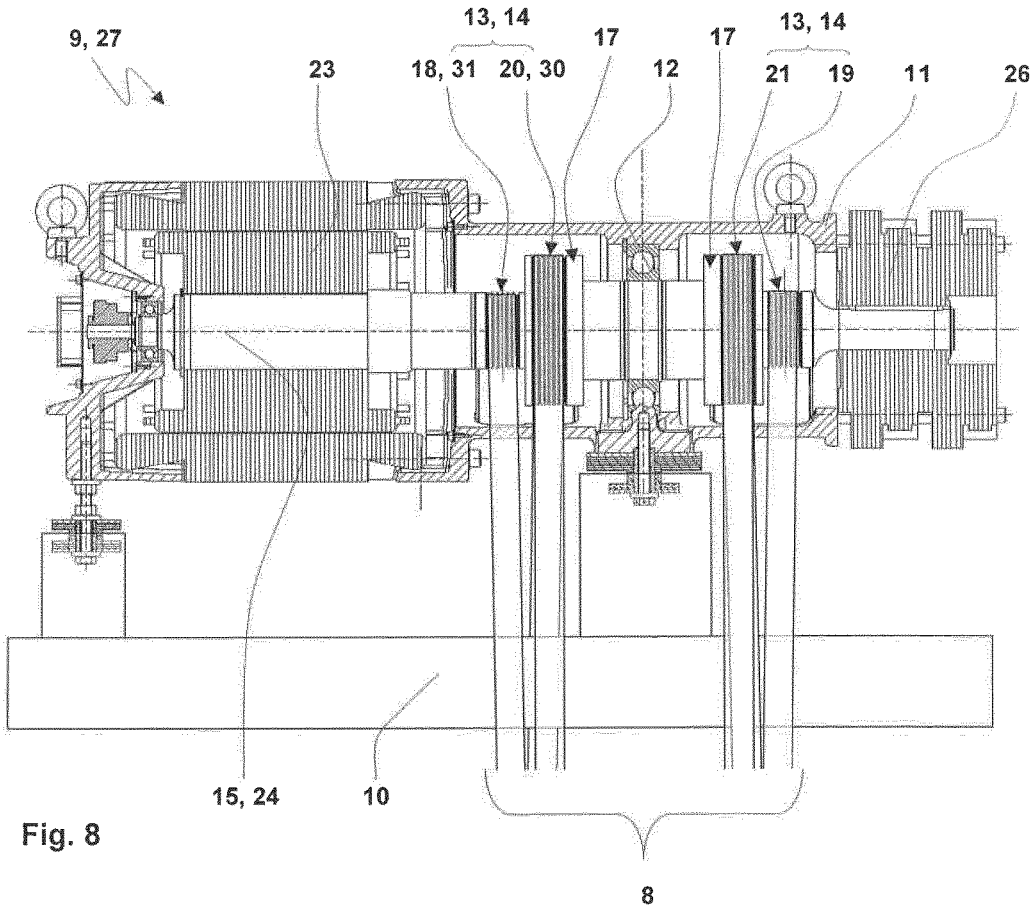
FIG. 8 shows an embodiment of a drive unit.

Various drive units 9, 27 such as can be used in the elevator installations explained in the foregoing are now presented in the following. FIG. 8 shows a basically known drive unit, such as has been made known already in the publication EP 1400479. The drive unit 9, 27 comprises a motor 23 with a motor axis 24. It is a gearless drive unit, i.e. the motor axis 24 at the same time forms a common rotational axis 15 on which also the drive unit rollers 18, 19, 20, 21, 30, 31 are arranged in a housing 11. These are used for supporting and driving the two travel bodies 3, 5 or the support means 8. The drive unit rollers 18, 19, 20, 21, 30, 31 are divided up into two drive unit roller sets 13. Arranged between the two drive unit roller sets 13 is a center bearing 12 which accepts a main support force of the drive unit. The drive unit equally comprises a brake 26 for holding the travel bodies in a stopped position. The drive unit 9, 27 is mounted on a carrier 10. The drive unit 9, 27 can be arranged and fastened in the elevator installation by means of the carrier 10. By contrast to the drive unit shown in the publication EP 1400479, however, the embodiment shown in FIG. 8 comprises drive unit rollers 18, 19, 20, 21, 30, 31 with different diameters so that during operation different circumferential speeds for the drive unit rollers arise. The first or the fourth drive unit rollers 18, 19, 31 are, in the embodiment, fixedly coupled with the common rotational axis 15 or formed therein and the second or the third drive unit rollers 20, 21, 30 are coupled with the common rotational axis 15 by means of a slip clutch 17. These second or third drive unit rollers 20, 21, 30 have, by comparison with the first or fourth drive unit rollers 18, 19, 31, twice the diameter, as a result of which during operation approximately twice the circumferential speed arises. The support means 8 can, as explained in the embodiments with respect to the preceding figures, be connected with the travel bodies 3, 5 in a 4:1 suspension. The drive unit rollers are all provided with traction surfaces so that a sufficient drive force is transmissible to the support means. Since the length of the support means between travel bodies and drive unit can change over a travel path of the travel bodies due to slip and stretching, small travel and speed displacements between the drive unit rollers can arise. Compensation for these is provided by the slip clutch 17.

Figure 9:
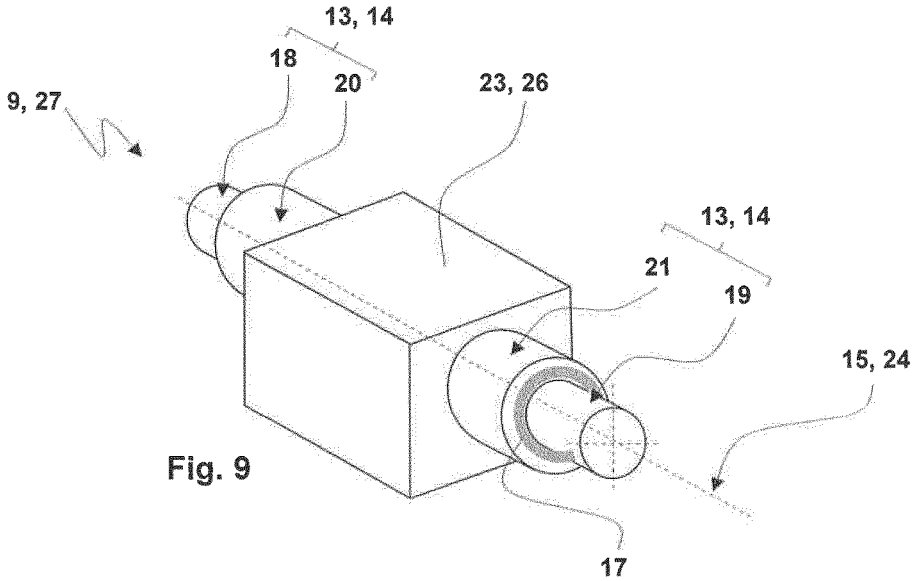
FIG. 9 shows a schematic embodiment of a drive unit with a speed change transmission between drive unit rollers.

FIG. 9 shows the drive unit of FIG. 8 in a schematic illustration, wherein in this embodiment the motor 23 together with the brake 26 is arranged between the two drive unit roller sets 13.

Figure 10:
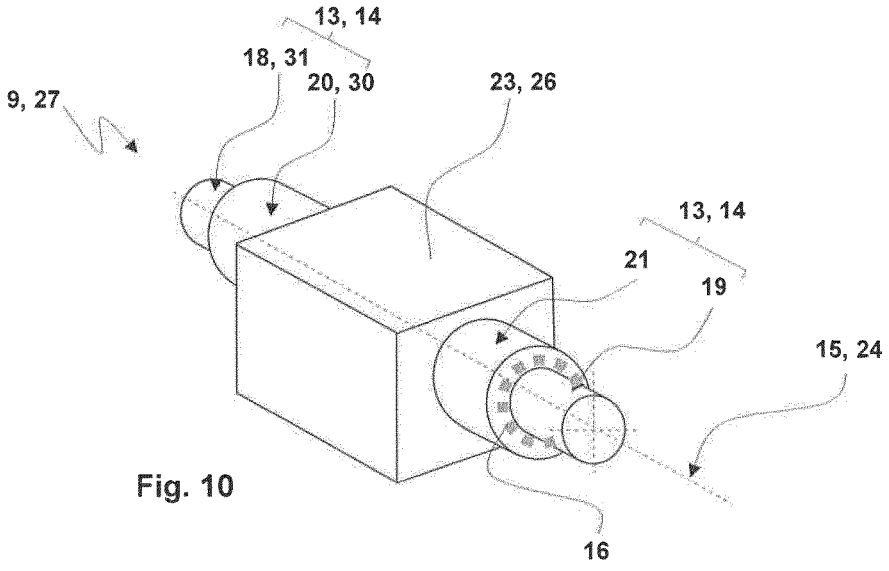
FIG. 10 shows a schematic embodiment of a drive unit with a coupling between the drive unit rollers.

FIG. 10 shows a modification of the drive unit of FIG. 9. The second drive unit rollers 20, 21 or the third drive unit roller 30 is or are coupled with the first or fourth drive unit rollers 18, 19, 31 by way of a differential transmission 16. The differential transmission 16 so couples the drive unit rollers together that a mean rotational speed is maintained. Compensation for travel and speed displacements can thus be provided. The differential transmission can be constructed in the form of, for example, a crown gear.

Figure 11:
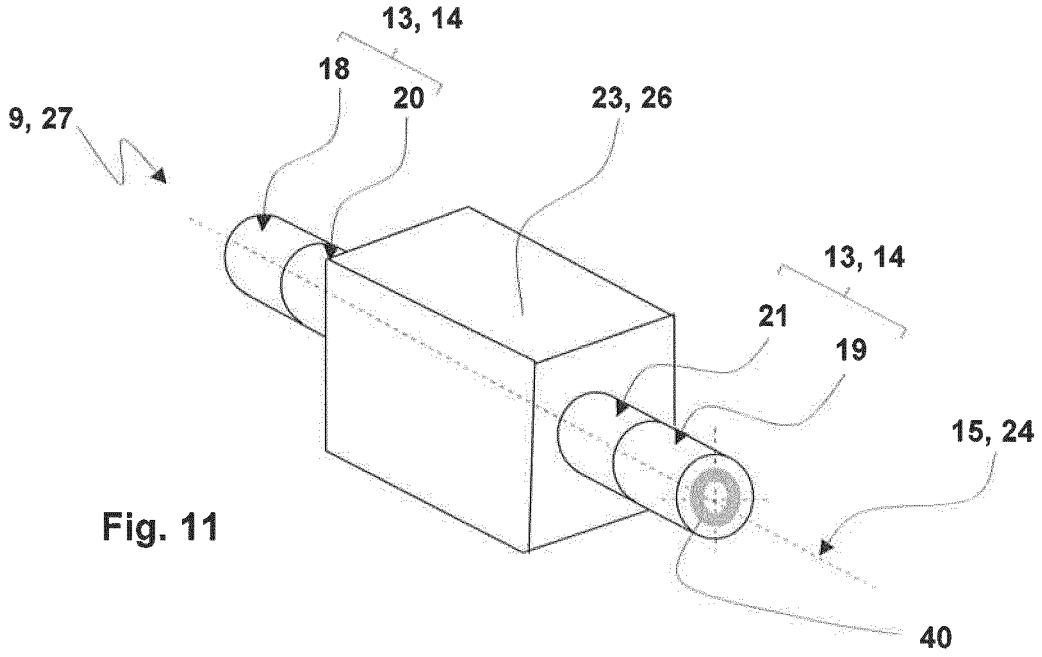
FIG. 11 shows a schematic embodiment of a drive unit with a free-wheeling drive unit roller.

FIG. 11 shows a further possible embodiment of a drive unit 9, 27. By contrast to the preceding examples all drive unit rollers 18, 19, 20, 21, 30, 31 of the drive unit 9, 27 have approximately the same diameter. However, the first drive unit rollers 18, 19 are mounted on the common rotational axis 15 by way of a free-wheeling bearing 40. The motor 23 thus drives merely the second drive unit rollers 21, 20 and the rotational speed of the first drive unit rollers 18, 19 necessarily results from the running speed of the support means 8.

Figure 12:
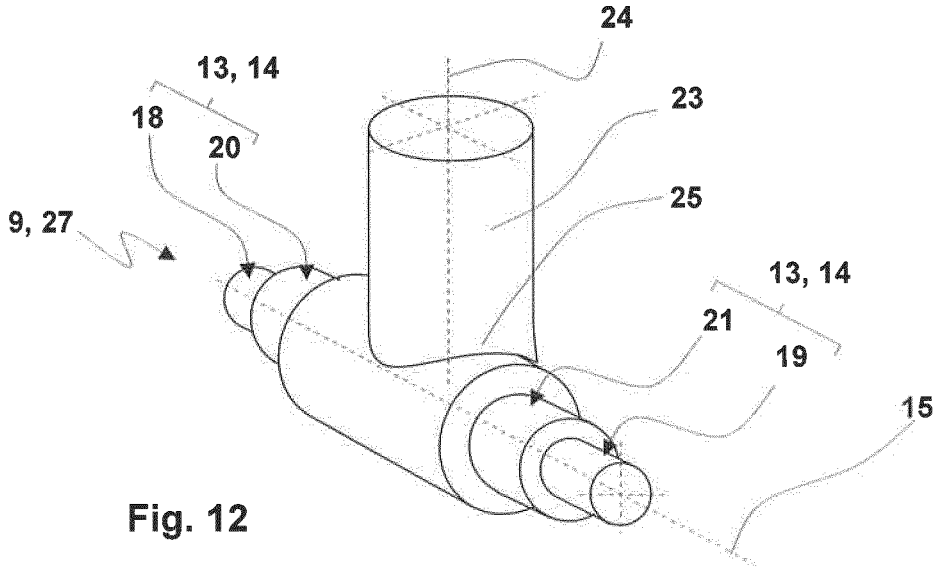
FIG. 12 shows a schematic embodiment of a drive unit with drive motor and transmission arranged at right angles.

FIG. 12 shows a further possible embodiment of a drive unit 9, 27. In that case, the motor 23 or the motor axis 24 is arranged at right angles to the common rotational axis 15. The motor 23 is preferably approximately at right angles to the rotational axis 15. Advantageously, it projects substantially vertically upwardly so that the drive overall demands little cross-sectional area. The motor acts on the rotational axis 15 by way of a transmission 25, for example a worm transmission or a bevel-gear transmission. The arrangement of the drive unit rollers can be selected analogously to the embodiments explained beforehand.

The illustrated drive units 9, 27 can be varied and combined. The motor 23 can be arranged on one side of the drive unit rollers and obviously several drive unit roller sets are possible depending on the number of required runs of support means. In addition, the design of the elevator installation can be varied. Thus, for example, even in the case of the embodiments according to FIGS. 1 to 3 an intermediate ceiling 2*a* can be included so that a smaller engine room 2*c* arises. Other suspension or hanging factors are also possible. The invention is not restricted to the described embodiments and the stated modifications. The arrangements of the support rollers 33, 34, 35 are variable according to requirements and optimum space utilization. In one variant of embodiment use can also be made of two motors 23, wherein a first motor drives the first drive unit roller 18, 19 and a second motor drives the second drive unit roller 20, 21. In that case introduction of drive force into the support means can be controlled according to need by controlling the two motors.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation having a first travel body and a second travel body with a support device supporting the travel bodies and with a drive unit driving the support device and the two travel bodies, comprising:

the first and second travel bodies each having a first support roller and the support device at least partly carries the first and second travel bodies by the first support rollers, wherein the first travel body is a counterweight and the second travel body is an elevator car;

the drive unit having a first drive unit roller and a second drive unit roller, the first and second drive unit rollers being arranged on a common rotational axis of the drive unit; and wherein at least one of the first and second drive unit rollers drives the support device, the support device being guided from the first travel body to the second travel body by the first drive unit roller and the second drive unit roller and respective circumferential speeds of the first and second drive unit rollers being different when the drive unit is driving the support device.

2. The elevator installation according to claim 1 including another drive unit or a deflecting device, the another drive unit or the deflecting device having a third drive unit roller and a fourth drive unit roller arranged on a common rotational axis of the another drive unit or the deflecting device, wherein the support device being guided from the first travel body to the second travel body is also guided by the third drive unit roller and the fourth drive unit roller, and wherein respective circumferential speeds of the third and fourth drive unit rollers are different when the another drive unit is driving the support device.

3. The elevator installation according to claim 2 wherein the first travel body has a second support roller and the support device is led in a 4:1 suspension to the first travel body or to the first and second support rollers thereof, wherein the support device starting from a first stationary fastening point in a shaft of the elevator installation is led to the first support roller of the first travel body, is led onward to the first drive unit roller of the drive unit, is led back to the second support roller of the first travel body and is led onward to the second drive unit roller of the drive unit, and wherein the circumferential speed of the second drive unit roller of the drive unit approximately corresponds with twice the circumferential speed of the first drive unit roller.

4. The elevator installation according to claim 3 wherein the second travel body has a second support roller and the support device is led in a 4:1 suspension to the second travel body or to the first and second support rollers thereof, the support device is led from the second drive unit roller of the drive unit onward to the fourth drive unit roller of the another drive unit or to the deflecting device, the support device is led onward to the second support roller of the second travel body, the support device is led back to the another drive unit or to the deflecting device and is guided by the third drive unit roller, the support device is led from the third drive unit roller onward to the first support roller of the second travel body and finally the support device is led from the first support roller of the second travel body onward to a second stationary fastening point of the support device in the shaft and is fastened there.

5. The elevator installation according to claim 3 wherein the second travel body has a fastening point at which the support device is fastened and the second travel body is arranged in a 3:1 suspension.

6. The elevator installation according to claim 1 wherein rotational axes of the first support rollers of the first and second travel bodies and the common rotational axis of the drive unit with the first and second drive unit rollers are parallel.

7. The elevator installation according to claim 1 including another drive unit or a deflecting device, the another drive unit or the deflecting device having a third drive unit roller and a fourth drive unit roller arranged on a common rotational axis of the another drive unit or the deflecting device, wherein rotational axes of the first support rollers of the first and second travel bodies, the common rotational axis of the drive unit with the first and second drive unit rollers, the common rotational axis of the another drive unit or the deflecting device with the third and fourth drive unit rollers are parallel.

8. The elevator installation according to claim 1 wherein the first support roller of the first travel body is arranged above the first travel body and the first support roller of the second travel body is arranged below the second travel body.

9. The elevator installation according to claim 1 wherein the elevator car has the first support roller arranged below the elevator car so that the support device is guided below the elevator car.

10. The elevator installation according to claim 1 wherein the support device is at least one support belt.

11. The elevator installation according to claim 10 wherein the support belt has a poly-V-ribbed traction surface, and the first and second drive unit rollers and the first support rollers each have one of a traction surface and guide surface shaped in correspondence with a shape of the support belt traction surface.

12. The elevator installation according to claim 10 including two of the support belt parallelly extending and supporting and driving the first and second travel bodies, and the drive unit includes two drive unit roller sets, each of the drive unit roller sets having one of the first drive unit roller and one of the second drive unit roller, and the drive unit roller sets being are arranged on the common rotational axis of the drive unit.

13. The elevator installation according to claim 10 wherein the support belt is bent in a same sense around the first support rollers and the first and second drive unit rollers.

14. A method of driving a first travel body and a second travel body of an elevator installation by a drive unit, comprising the steps of: providing the drive unit including a first drive unit roller and a second drive unit roller arranged on a common rotational axis, and a support device connecting the first and second travel bodies with the first and second drive unit rollers, wherein the first travel body is a counterweight and the second travel body is an elevator car;

fastening one end of the support device to a first stationary fastening point in a shaft of the elevator installation;

leading the support device from the first stationary fastening point to a first support roller of the first travel body;

leading the support device from the first support roller to the first drive unit roller of the drive unit and looping the support device at least partly around the first drive roller;

leading the support device from the first drive unit roller to a second support roller of the first travel body; and leading the support device from the second support roller to the second drive unit roller of the drive unit and looping the support device at least partly around the second drive unit roller, wherein the drive unit includes a drive motor, wherein at least one of the first and second drive unit rollers has a traction surface for driving the support device and is coupled with the drive motor, wherein another one of the first and second drive unit rollers is coupled with the drive motor, wherein when the first and second drive unit rollers are driven by the drive motor, respective circumferential speeds of the first and second drive unit rollers are different, or the another one of the first and second drive unit rollers is arranged on the common rotational axis to be freely rotatable so that the circumferential speed of the another one of the first and second drive unit rollers can differ from the circumferential speed of the at least one of the first and second drive unit rollers.

* * * * *